US008979002B2

(12) United States Patent
Gerbron et al.

(10) Patent No.: US 8,979,002 B2
(45) Date of Patent: Mar. 17, 2015

(54) VENTURI-EFFECT SPRAYING DEVICE AND ITS USE IN COSMETOLOGY AND IN PERFUMERY

(75) Inventors: Jaques Gerbron, Menton (FR); Marc Chevalier, Franconville (FR)

(73) Assignee: LVMH Recherche, Saint Jean de Braye (FR)

( * ) Notice: Subject to any disclaimer, the term of this patent is extended or adjusted under 35 U.S.C. 154(b) by 766 days.

(21) Appl. No.: 12/652,848

(22) Filed: Jan. 6, 2010

(65) Prior Publication Data

US 2010/0252656 A1 Oct. 7, 2010

(51) Int. Cl.

| | |
|---|---|
| ***B05B 7/30*** | (2006.01) |
| ***B05B 7/04*** | (2006.01) |
| ***B05B 15/06*** | (2006.01) |
| ***B05B 1/04*** | (2006.01) |
| ***B05B 11/06*** | (2006.01) |
| ***A45D 33/02*** | (2006.01) |

(52) U.S. Cl.

CPC ..... *B05B 11/061* (2013.01); *B05B 11/062* (2013.01); *A45D 33/02* (2013.01)

USPC ..... 239/318; 239/434; 239/311

(58) Field of Classification Search

CPC ..... B05B 7/30; B05B 7/04; B05B 15/06; B05B 1/04; A62C 13/62; A62C 13/66

USPC ..... 239/318, 434, 633, 209, 594, 340

See application file for complete search history.

(56) References Cited

U.S. PATENT DOCUMENTS

| | | | | |
|---|---|---|---|---|
| 1,877,252 | A * | 9/1932 | Patou | 239/363 |
| 2,665,170 | A * | 1/1954 | Schmitt et al. | 239/353 |
| 2,755,132 | A * | 7/1956 | Croce | 239/353 |
| 3,008,651 | A * | 11/1961 | Follain | 239/353 |
| 3,345,111 | A | 10/1967 | Bies et al. | |
| 3,430,865 | A * | 3/1969 | McDougall | 239/427.5 |
| 3,770,209 | A * | 11/1973 | Wilcox | 239/434 |
| 5,765,758 | A * | 6/1998 | Chu | 239/369 |
| 7,080,761 | B1 | 7/2006 | Yu | |
| 7,490,742 | B2 * | 2/2009 | Yu | 222/183 |
| 2004/0056112 | A1 * | 3/2004 | Faye et al. | 239/424 |
| 2008/0073378 | A1 * | 3/2008 | Yu | 222/321.1 |
| 2011/0163183 | A1 * | 7/2011 | Ko | 239/302 |
| 2011/0233306 | A1 * | 9/2011 | Ko | 239/337 |

FOREIGN PATENT DOCUMENTS

| | | |
|---|---|---|
| EP | 0178120 | 4/1986 |
| EP | 0430438 A2 | 6/1991 |

(Continued)

OTHER PUBLICATIONS

International Search Report issued in related PCT Application PCT/FR2008/051242; report dated Nov. 27, 2008.

(Continued)

*Primary Examiner* — Justin Jonaitis

(74) *Attorney, Agent, or Firm* — Miller, Matthias & Hull LLP

(57) ABSTRACT

A manual compressed-air spraying device comprising a head in which are fixed an air nozzle forming a venturi and an output nozzle is disclosed. The head delimits, between the venturi and the output nozzle, a mixing chamber into which directly opens a conduit for channelling product to be sprayed. The output nozzle presents a convergent section and a divergent section downstream of the convergent section.

16 Claims, 6 Drawing Sheets

(56) References Cited

FOREIGN PATENT DOCUMENTS

| | | |
|---|---|---|
| FR | 999 959 | 2/1952 |
| FR | 1 524 931 | 5/1968 |
| GB | 387 863 | 2/1933 |
| GB | 582 099 | 11/1946 |
| GB | 715 791 | 9/1954 |
| JP | 2000-512901 | 10/2000 |
| JP | 2000512901 A | 10/2000 |
| JP | 2005-095886 | 4/2005 |
| JP | 2005095886 A | 4/2005 |
| WO | WO 90/01375 | 2/1990 |
| WO | WO-98/46366 | 10/1998 |

OTHER PUBLICATIONS

Preliminary Search Report issued in related French Patent Application No. FR0704989; report dated Feb. 27, 2008.

* cited by examiner

VENTURI-EFFECT SPRAYING DEVICE AND ITS USE IN COSMETOLOGY AND IN PERFUMERY

CROSS-REFERENCE TO RELATED APPLICATIONS

This application is a U.S. national stage filing of International Patent Application No. PCT/FR2008/051242 filed on Jul. 3, 2008, which claims priority under the Paris Convention to French Application No. 07 04898, filed on Jul. 6, 2007.

FIELD OF THE DISCLOSURE

This invention relates to venturi spraying devices and to the uses of such devices in cosmetology and in perfumery.

More particularly, the invention relates to a spraying device comprising:

- a distributor comprising:
  - a head,
  - an air nozzle and an output nozzle each molded from a single part made of synthetic material and assembled in the head,
  - an air circuit including at least, from upstream to downstream, an air inlet conduit at least partially formed in the air nozzle and a venturi formed in the air nozzle and an output conduit formed in the output nozzle, the venturi defining a vacuum zone in the air circuit,
- a conduit for channeling product to be sprayed extending according to a substantially vertical direction and communicating with the vacuum zone of the air circuit,
- a manual compressed-air generator communicating with the air inlet conduit,
- a reservoir adapted to contain the product to be sprayed, communicating with the conduit for channeling product to be sprayed.

BACKGROUND OF THE DISCLOSURE

U.S. Pat. No. 7,080,761 describes an example of such a spraying device, wherein the product to be sprayed must follow a complex and narrow path between the conduit for channeling and the output conduit, in such a way that this type of spraying device can possibly operate for spraying a liquid product, but not for spraying a powdery product.

In addition, the form of the output conduit disclosed in this document is also not suited for the spraying of powdery product.

Finally, the air nozzle of this document has a form that is entirely not suited for the effective carrying out of a vacuum capable of sucking the product to be sprayed.

SUMMARY OF THE DISCLOSURE

This invention has in particular for purpose to overcome these disadvantages.

To this effect, according to the invention, a spraying device of the type in question is characterized in that the head delimits a mixing chamber between the air nozzle and the output nozzle, said mixing chamber forming said vacuum zone and being arranged directly above the conduit for channeling, in that the venturi comprises a convergent section, and in that the output conduit comprises a divergent section open towards the exterior and a convergent section open towards the mixing chamber upstream of the divergent section.

Thanks to these arrangements, the spraying device according to the invention is adapted to effectively spray powdery products, as well as liquid products. In addition, the form of the Venturi, provided with a convergent section, allows for effective suction of the product to be sprayed.

In various embodiments of the spraying device according to the invention, further recourse is possible to one and/or the other of the following arrangements:

- the output conduit comprises an inlet cone open towards the mixing chamber, said inlet cone being arranged upstream of said convergent section of the output conduit and having an angle at the top between 30 and 60 degrees and greater than an angle at the top formed by the convergent section;
- the distributor comprises a protruding portion which penetrates in the mixing chamber above the conduit for channeling;
- the air nozzle has an end in the form of a point forming said protruding portion;
- the conduit for channeling has a section of passage having a first portion overhung by said protruding portion and a second portion not overhung by said protruding portion;
- the head comprises a nozzle housing extending horizontally and wherein are nested the air nozzle and the output nozzle;
- the air nozzle and the output nozzle are nested in the head;
- the head is molded of synthetic material;
- the air inlet conduit has a first section and the venturi has a minimal section, said minimal section having an area between 1% and 6.5% of the area of said first section;
- the air inlet conduit is formed at least partially in a tip fixed to the air nozzle by nesting and connected to said manual compressed-air generator;
- the distributor comprises an inlet valve which is adapted in order to allow only the circulation of air towards the venturi and which is arranged on air inlet conduit, said inlet valve comprising a valve member solicited by a spring towards a valve seat directed towards the venturi;
- the output conduit has an output section between 0.25 and 1.2 $mm^2$;
- the head comprises a well that opens vertically in the mixing chamber and wherein is nested a dip tube which delimits at least partially the conduit for channeling product to be sprayed;
- the dip tube has an internal diameter between 0.6 and 2 mm;
- the head is covered by an added external envelope;
- the manual compressed-air generator is a flexible bulb;
- the manual compressed-air generator is a piston pump.

Moreover, the invention also has for objective a use of a device such as defined hereinabove, for the spraying of a powdery product. This powdery product can be for example a perfumery product, a cosmetic product, or other.

BRIEF DESCRIPTION OF THE DRAWINGS

Other characteristics and advantages of the invention shall appear during the course of the following description of several of its embodiments, provided by way of non-restricted examples, with regards to the attached drawings.

In the drawings.

DETAILED DESCRIPTION OF THE DISCLOSURE

In the various figures, the same references designate identical or similar elements.

Figure 1:
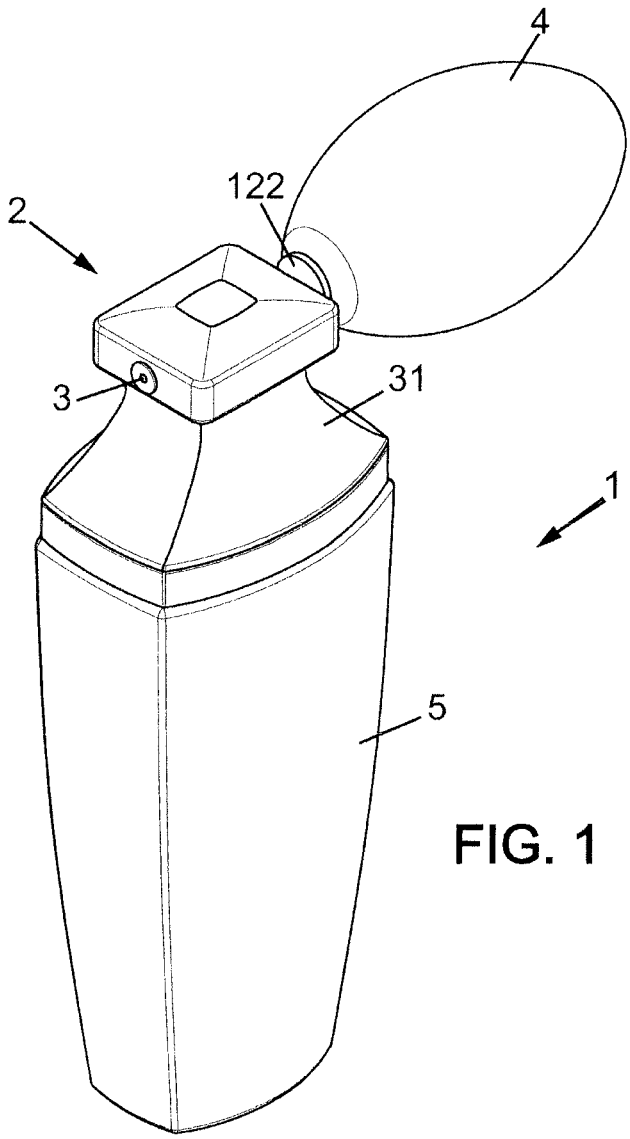
FIG. 1 is a general view of a spraying device according to a first embodiment of the invention.

FIG. 1 shows a portable spraying device comprising:

- a distributor 2 adapted to spray a product by an outlet orifice 3,
- a manual compressed-air generator, for example a flexible bulb 4 made of elastomer or same, making it possible to insufflate air, for example in the form of an air stream, in the distributor 2 to spray the product in an air flow by the outlet orifice 3,
- a reservoir 5 adapted to contain the product to be sprayed, communicating with the distributor 2.

The product to be sprayed 6 contained in the reservoir 5 (see FIG. 2) can be for example a powdery product, in particular a perfumery product, a cosmetic product, or other.

This powdery product, in particular a composition in the form of free perfumed cosmetic powder, can for example have a granulometry between a few micrometers and 200 μm, and a density between 0.6 and 1. This entails for example a mineral powder (such as mica, mineral pigments, etc.) or an organic powder (polyamide, PMMA or other), or a mixture of such mineral and organic powders. This product can also contain a mixed powder such as for example organic coloring agents fixed on a mineral support.

Note that the bulb 4 can for example comprise an air inlet valve 4*a* allowing the air to enter into the bulb 4 when it inflates via elasticity, but preventing the air outlet towards the exterior when a user presses said bulb 4.

Figure 2:
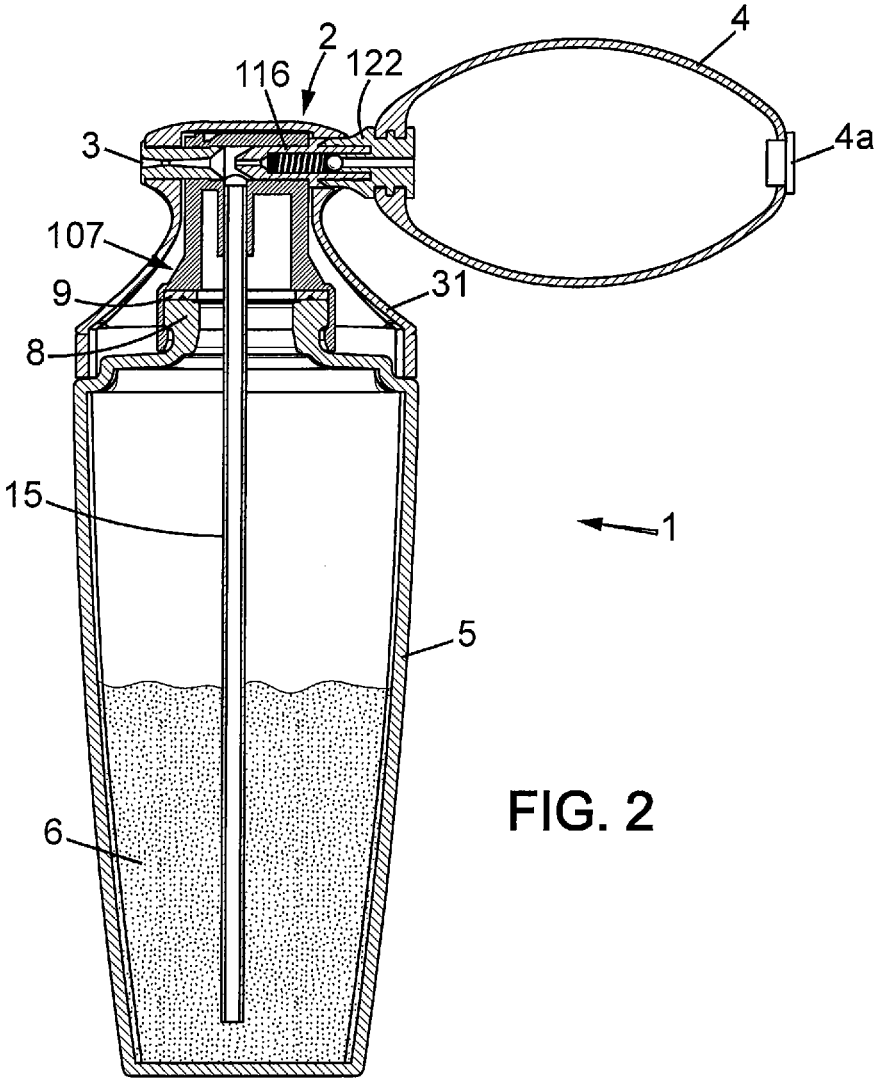
FIG. 2 is a vertical cross-section view of the device in FIG. 1.
Figure 3:
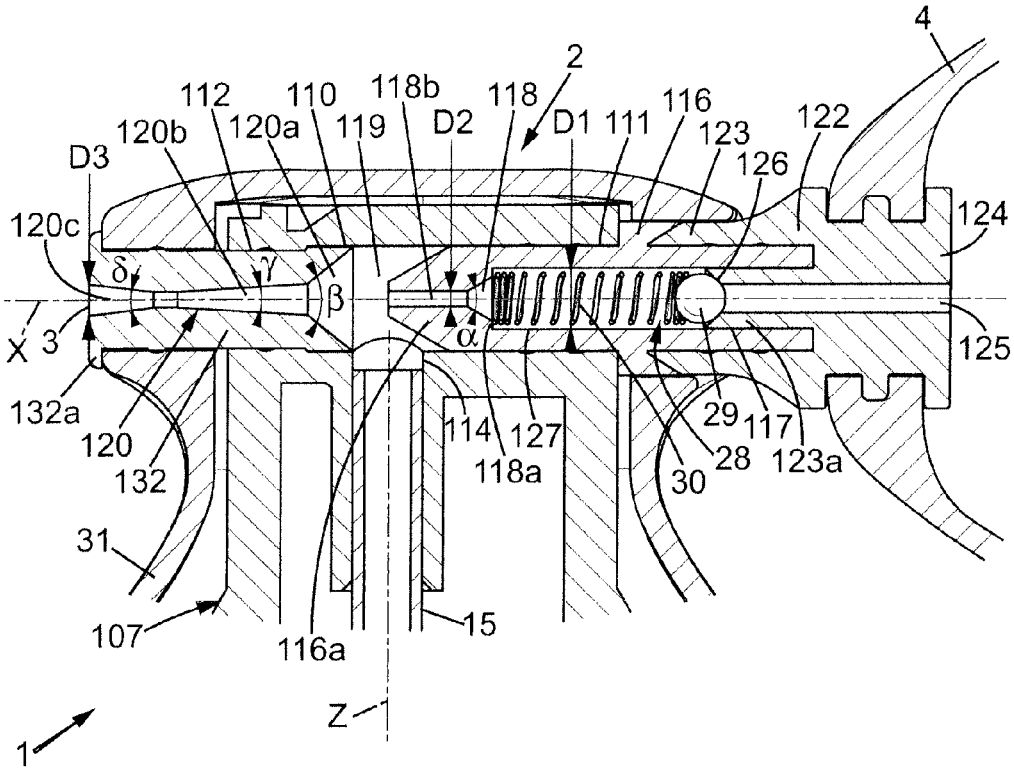
FIG. 3 is a detailed view of the section in FIG. 2.
Figure 4:
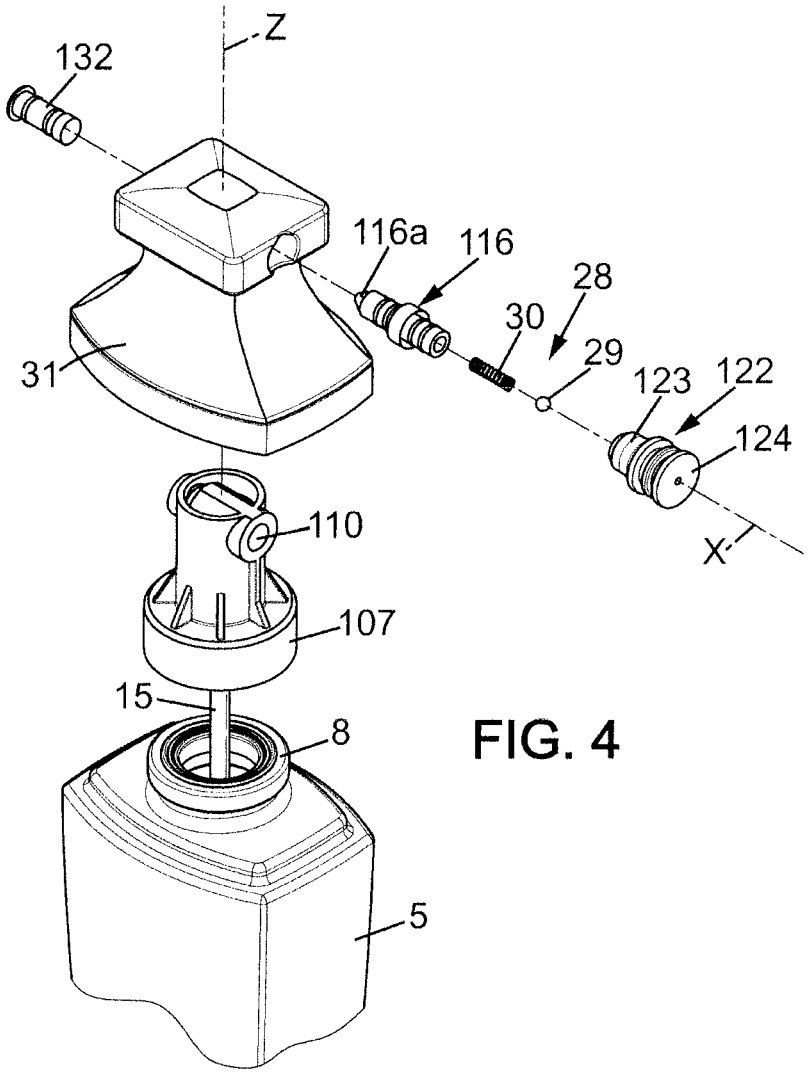
FIG. 4 is an exploded view of a portion of the device in FIGS. 1 and 2.

As shown in the FIGS. 2 to 4, the distributor 2 can comprise a head 107 which can for example be molded of plastic material. This head 107 can be fixed by clipping-on or other on the neck 8 of the reservoir 5, in such a way as to close said reservoir. A seal 9 can where applicable be interposed between the head 107 and the neck 8.

Finally, the head 107 can where applicable be covered by a decorative added external envelope 31 (FIGS. 1 to 4) which has recesses on the outlet orifice 3 and a tip connecting the head 107 to the bulb 4.

The head 107 is crossed by a nozzle housing 110 which, in the example shown in the drawings, has a general form of a revolution around a substantially horizontal axis X, for example a cylindrical form.

The head 107 further comprises a well 114 extending according to a substantially vertical axis Z, which opens directly upwards in a mixing chamber 119 delimited by the nozzle housing 110. In the well 114 is nested by force a dip tube 15 made of plastic material, delimiting a conduit for channeling product to be sprayed, extending downwards in the reservoir 5 and dipping into the product 6 to be sprayed (see FIGS. 2 to 4). The dip tube can for example have an internal diameter between 0.6 and 2 mm.

At the rear end 111 of the nozzle housing 110 is nested an air nozzle 116 which is molded of a single part made of synthetic material, in particular of thermoplastic.

As shown in more detail in FIG. 4, the air nozzle 116 can have an exterior form that is complementary to the nozzle housing 10, in such a way as to be able to be nested by force via the rear end 11 of said nozzle housing. The air nozzle 116 is crossed by a recess centered on the axis X, which forms, from the rear towards the front:

- a tip housing 117, having for example a cylindrical form of a revolution centered on the axis X, of diameter D1,
- then a tapered convergent section 118, which in the example considered here is surrounded by a shoulder 118*a*,
- then a narrowed conduit 118*b*, having for example a cylindrical form of a revolution centered on the axis X, of diameter D2.

The conduit 118*b* opens in the mixing chamber 119 of the head 107, at the front end 116*a* of the air nozzle 116. Said front end 116*a* of the air nozzle can have a form of a point, for example tapered, protruding in the mixing chamber 119.

In the example in FIGS. 1 to 4, a tip 122, which can be for example molded from plastic material, is nested by force in the tip housing 117.

As shown in more detail in FIG. 3, the tip 122 comprises a front end 123 and a rear end 124 whereon the bulb 4 is fixed in a sealed manner. The front end 123 of the tip 122 is nested to the exterior of the rear end of the air nozzle 116, and said tip further comprises a tubular portion 123*a*, formed in the interior of the front end 123, which is nested in the tip housing 117. The tip 122 is pierced with a central recess which extends according to the axis X and which forms, from the rear towards the front:

- an upstream conduit 125 of relatively small diameter, which opens towards the rear in the bulb 4,
- a valve seat 126 diverging towards the front.

The air nozzle 116 further contains an inlet valve 28 which comprises a valve member 29, for example a ball made of plastic material or other, and coiled spring 30 supporting the convergent section 18 (or for example on a shoulder 118*a* surrounding this convergent section 18) and soliciting the valve member towards the rear, in contact against the valve seat 126.

At the front end 112 of the nozzle housing is furthermore nested by force an output nozzle 132 which delimits the output conduit 120, this output nozzle 132 also being nested by force in the recess arranged across from the output 3 in the added external envelope 31. The output nozzle 132 does not extend to the contact of the air nozzle 116, in such a way that these two nozzles leave in the nozzle housing 110 a free space which constitutes the aforementioned mixing chamber 119. The output nozzle 132 can comprise at its front end, an external collar 132*a* which abuts against the external envelope 31.

The output nozzle 132 comprises, from the rear towards the front (i.e. from upstream towards downstream):

- a convergent inlet cone 120*a* open towards the mixing chamber 119 and having a relatively substantial angle at the top β, for example between 30 and 60 degrees,
- then a convergent section 120*b* having a relatively small angle at the top γ, of a few degrees (for example less than 10 degrees),
- then, where applicable, a short cylindrical portion (not referenced),
- then a divergent section 120*c* also having a relatively small angle at the top δ (for example less than 15 degrees) and opening towards the exterior via the outlet orifice 3, of a section similar to the section of the first embodiment. Thanks to the presence of the convergent section 120*b* and of the divergent section 120*c* in the output conduit, the clogging of the output conduit 120 by agglomerates of powdery material is avoided or limited.

The head 107, the air nozzle 116, the tip 122 and the output nozzle 132 delimit as such an air circuit comprising, from upstream to downstream (i.e. from the rear towards the front in this case):

the upstream conduit 25, the inlet valve 28, the air inlet conduit 127, delimited in the tip housing 117 downstream of the tip 122, the convergent section 118 and the conduit 118*b*, the mixing chamber 119, the output conduit 120.

The convergent section 118 of the air nozzle 116, forms a venturi which defines a vacuum zone corresponding substantially to the mixing chamber 119, which is pressurized when air circulates in the air circuit from upstream towards downstream. Due to the fact that the venturi is formed in a part molded from synthetic material, its form is perfectly defined and can be reproduced from one spraying device to the other, independently of any mounting tolerance, in such a way that the vacuum created by the venturi is also perfectly defined.

In the particular case shown in the FIGS. 1 to 4, the air inlet conduit 127 is cylindrical, of diameter D1 for example between 2 and 3 mm (in particular of a magnitude of 2.3 mm) and the minimum diameter D2 of the convergent section 118 is for example between 0.5 and 0.7 mm (in particular of a magnitude of 0.6 mm). The ratio of the diameters D1/D2 can be between 10% and 25% or, more generally, the ratio between the area of the corresponding sections can be between 1% and 6.5%. The angle at the top $\alpha$ of the convergent section 118 can for example be between 20 and 40 degrees.

In light of the fact that the head 107 can where applicable be covered by a decorative added external envelope 31, the head 107 is independent of the exterior style of the spraying device 1. In addition, the air nozzle 116 and the output nozzle 132 can themselves be standard parts used on several types of sprayers 1, independently not only in relation to the exterior style of the spraying device 1, but also to the type of head 107 (several types of head 107 can be used according to the applications, in particular in order to adapt to several types of reservoirs 5).

A modular device can as such be manufactured comprised of a small number of thermoplastic parts which are simple to produce, and which implement all of the functions of the connection to the compressed air generator, venturi, channeling product, fixing on a recipient, product output, etc. These parts are assembled for example by simple nesting in relation to one another.

The device which has just been described operates as follows. When a user presses the bulb 4, the inlet valve 4*a* of this bulb remains closed and the air contained in the bulb is compressed and insufflated into the distributor 2, by following the air circuit of this distributor. Subsequent to its passing in the venturi formed by the convergent section 118, the air flow creates a vacuum (by decreasing the pressure for example by 20 to 40 mbar [i.e. the equivalent of a column of 20 to 40 cm of water] in relation to the ambient pressure).

This vacuum sucks the powdery product via the dip tube. If the powdery product has agglomerates, these possible agglomerates are disintegrated by the front end 116*a* in the form of a point which protrudes into the mixing chamber 119 above the conduit for channeling delimited by the dip tube 15 (this front end in the form of a point does not however hinder the arrival of the powdery product in the mixing chamber 119 due to the form of a point of this front end and due to the fact that it does not fully overhang the section of passing of the conduit for channeling.

Note that the spraying device according to the invention makes it possible to spray a substantially constant dose of powdery product, right from the first actuating of the bulb 4, and this, regardless of the level of product 6 in the reservoir 5, as soon as the lower end of the dip tube 15 dips into the product 6.

Figure 5:
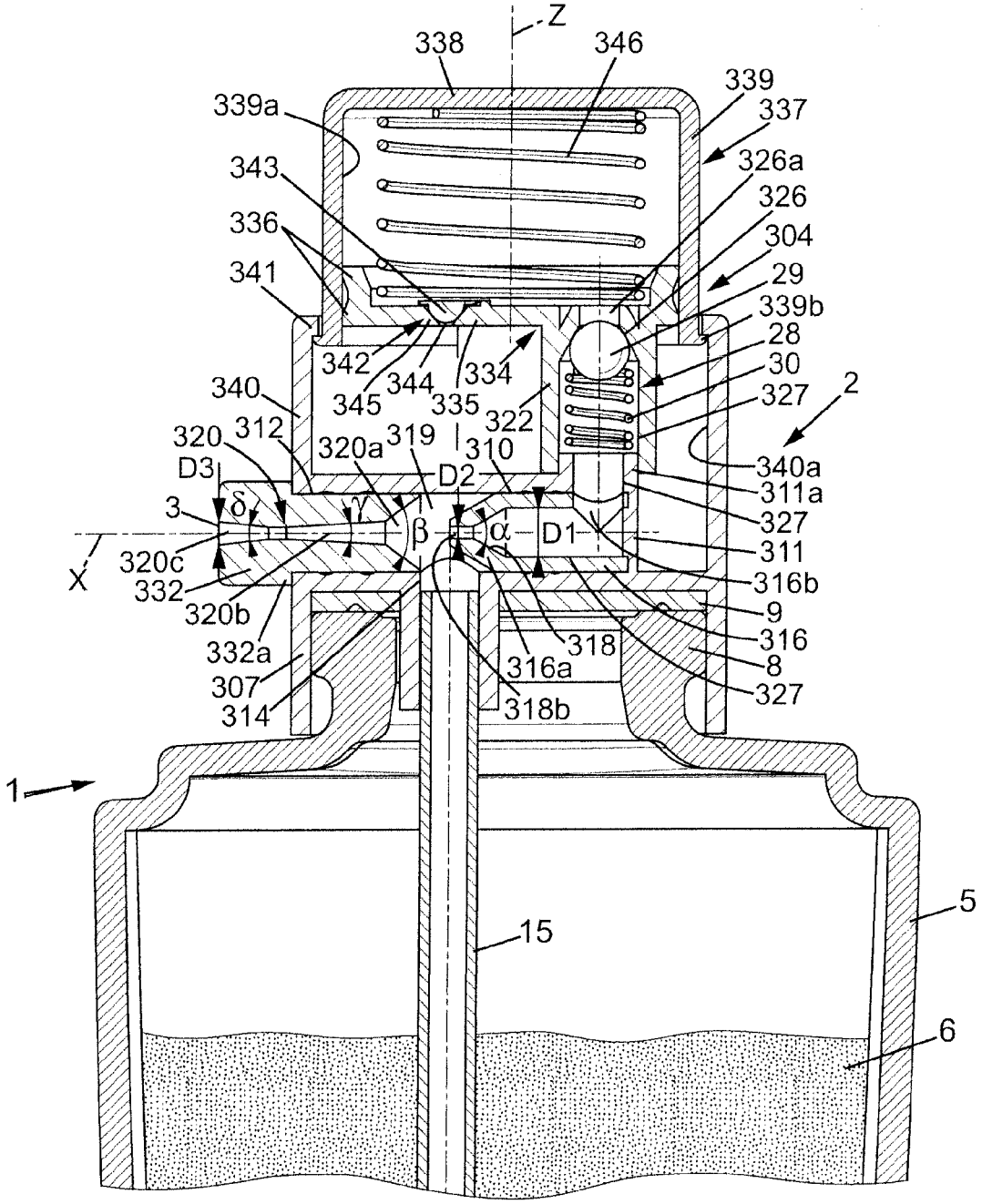
FIG. 5 is a view similar to the FIG. 3, in a second embodiment of the invention.
Figure 6:
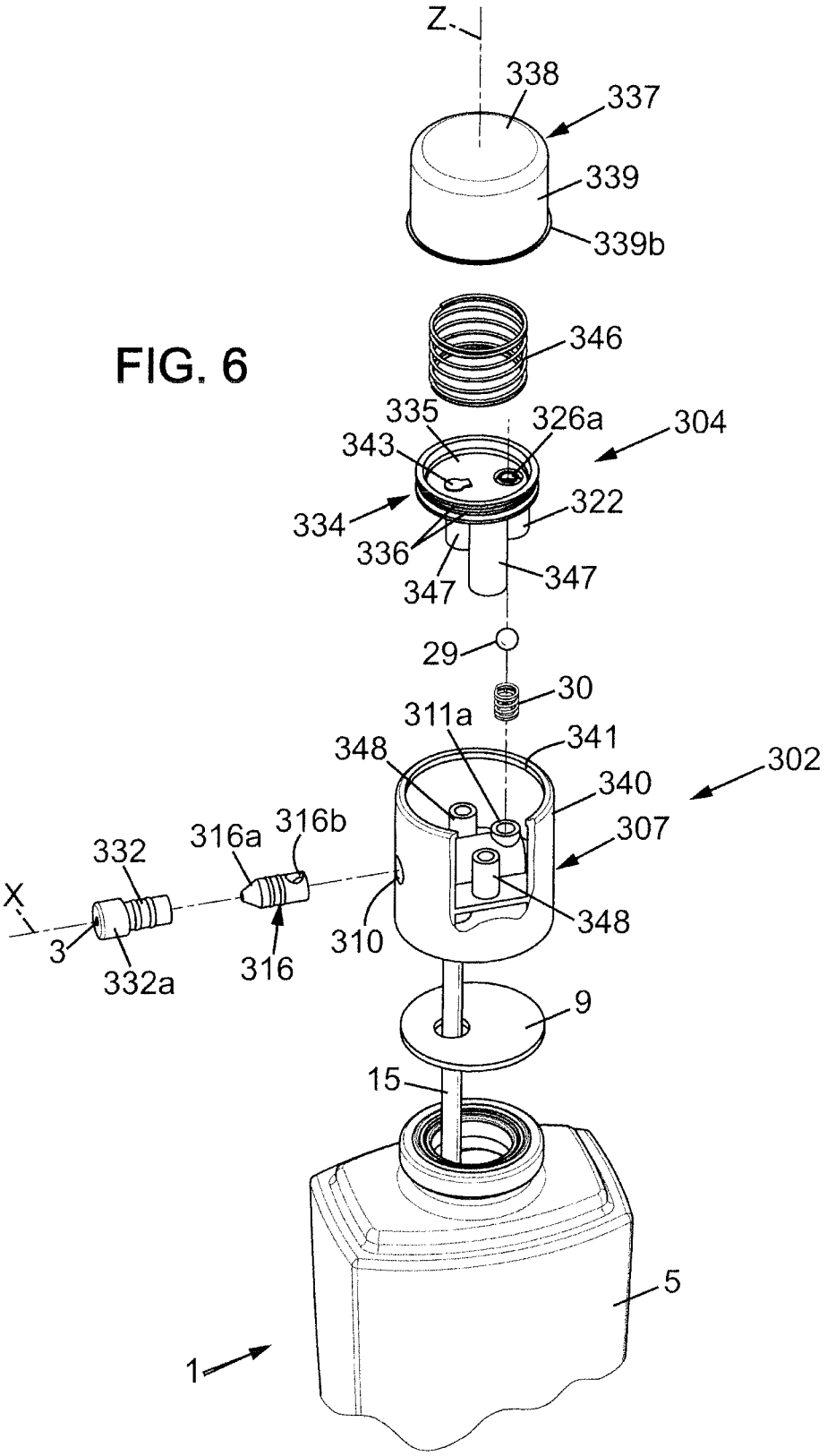
FIG. 6 is a view similar to the FIG. 4, in the second embodiment of the invention.

In the second embodiment of the invention, shown in the FIGS. 5 and 6, the spraying device 1 comprises as hereinabove a distributor 2 provided with an outlet orifice 3, a manual compressed-air generator, comprised here of a manual pump 304, and a reservoir 5 containing the product to be sprayed 6, which can be for example similar to the powdery product described hereinabove.

The distributor 2 comprises a head 307 which can for example be molded from plastic material and which can in particular be fixed by clipping-on or other on the neck 8 of the reservoir 5, a seal 9 able to be, where applicable, interposed between the head 7 and the neck 8.

In the head 7 is arranged a cylindrical nozzle housing 310 which opens towards the exterior at a front end 312. The nozzle housing 310 extends according to a substantially horizontal axis X from the front end 312 to a rear end 311 where said nozzle housing is extended upwards by a shaft 311*a* of which the lateral wall protrudes upwards.

The head 307 comprises as hereinabove, a well 314 which opens upwards in the nozzle housing 310 and which extends downwards, in parallel to a substantially vertical axis Z. In the well 314 can be nested a dip tube 15 made of plastic material or other, which extends downwards by dipping into the product to be sprayed 6 contained in the reservoir 5. The dip tube 15 as such comprises, as hereinabove, a conduit for channeling product to be sprayed towards a mixing chamber 319 delimited on the inside by the nozzle housing 310, above the well 314.

At the rear end 311 of the nozzle housing is nested by force an air nozzle 316 which is molded of a single part of synthetic material, in particular thermoplastic. The air nozzle 316 has an exterior cylindrical form that is complementary to the interior form of the nozzle housing 310, and it delimits interiorly a cylindrical air inlet conduit 327 of diameter D1, centered on the axis X. This inlet conduit 327 is extended, to 90 degrees upwards, inside the shaft 311*a*, passing through a hole 316*b* arranged at the rear end of the air nozzle 316.

The air inlet conduit 327 is extended towards the front, in the air nozzle 316, by a tapered convergent section 318 which can have an angle at the top for example between 20 and 40 degrees and which is extended by a short narrowed passage 318*b* of diameter D2, arranged at the front end 316*a* of the air nozzle. The diameters D1 and D2 can be similar to the diameters already described in the first embodiment of the invention.

The front end 316*a* of the air nozzle can be in the form of a point, in particular in a tapered form, and protrudes into the aforementioned mixing chamber 319, above the well 314.

Moreover, at the front end 312 of the nozzle housing is nested by force an output nozzle 332 of which the rear end arrives at the limit of the mixing chamber 319 and of which the front end comprises an exterior collar 332*a* coming to abut against the exterior lateral wall of the head 307.

The output nozzle 332 delimits the output conduit 320 which can for example comprise a convergent inlet cone 320*a* open towards the mixing chamber 319, followed by a convergent section 320*b* then where applicable by a short cylindrical passage of transition and finally by a divergent section 320*c* opening towards the exterior on the outlet orifice 3, diameter D3. The form and the dimensions of the outlet passage 320 and of the outlet orifice 3 can be identical or similar in form and in dimension of the output passage 120 and of the outlet orifice 3 of the second embodiment described hereinabove.

Moreover, on the aforementioned shaft 311*a*, can be nested a tip 322 belonging to a part 334 which can be molded of plastic material. The tip 322 has a general cylindrical form of revolution centered on a vertical axis parallel to the axis Z and extends upwards to a tapered portion which converges upwards by forming a valve seat 326. The valve seat 326 is normally sealed by a valve member 29 solicited upwards par coiled spring 30 pressing against the upper end of the shaft 311*a*. The valve member 29 and the spring 30 can be identical or similar to those already described hereinabove. The valve member 29 forms with the spring 30 and the valve seat 326 an air inlet valve 28 which allows only the entry of the air in the air inlet conduit 327, through a recess 326*a* arranged in the center of the valve seat 326.

The part 334 made of plastic material forms moreover a substantially horizontal piston 335 and has for example a form of a disk centered on the axis Z.

The piston 335 can comprise exteriorly one or several peripheral lips 336 whereon is nested a push-button 337 in the form of an inverted cup, made for example by molding of plastic material.

The push-button 337 can comprise for example an upper bottom 338 extended downwards by a cylindrical skirt 339 centered on the axis Z, the interior wall 339*a* of this skirt sliding sealingly on the peripheral lips 336 of the piston.

At its lower end, the cylindrical skirt 339 of the push-button is extended radially towards the exterior, by a flange ring 339*b* (or where applicable by exterior prongs) which is guided by vertical sliding, without sealing, by the cylindrical interior surface 340*a* of an annular lateral wall 340 centered on the axis Z, which can be formed of a single part with the head 307.

The annular lateral wall 340 comprises, at its upper end, an interior rim 341 (continuous or discontinuous) against which abuts the flange ring 339*b* upwards, in order to limit the sliding upwards of the push-button 337.

In the piston 335 can furthermore be formed an air inlet valve 342 which allows only the entry of air from the exterior, via the space located below the piston 335, towards the space delimited between the piston 335 and the push-button 337. This valve 342 can comprise for example an orifice 344 of tapered form, expanded upwards, which delimits as such a valve seat 345 against which is applied a valve member 343 which can for example be formed by a tab molded from a single part with the piston 335 and connected to this piston by a zone forming a hinge 343*a*.

Moreover, coiled spring 346 is interposed between the piston 335 and the bottom 338 of the push-button 337.

Finally, the piston 335 can be supported by two cylindrical tubular supports 347 which extend downwards according to the axis Z starting from the lower surface of said piston and which are nested by force on two cylindrical tenons 348 molded from a single part with the head 307 and extending upwards starting from said head (see FIG. 10).

The device that has just been described operates as follows.

When a user presses on the push-button 337, against the solicitation of the spring 346, he compresses the air contained in the chamber which is delimited between the piston 335 and the push-button 337, in such a way that this compressed air is expulsed through the air inlet valve 28, towards the air inlet conduit 327, then the convergent section 318 forming venturi, then the mixing chamber 319 where a vacuum is produced sucking upwards the powdery product 6 contained inside the reservoir 5. This powdery product is mixed with the air flow inside the chamber 319, and then sprayed towards the exterior through the output conduit 320 as explained hereinabove.

When the user releases the push-button 337, the latter returns to its initial position under the solicitation of the spring 346. During this movement, the air inlet valve 28 remains closed, but the valve 342 opens, allowing the entry of air into the chamber delimited between the piston 335 and the push-button 337.

The invention claimed is:

1. A distributor for a spraying device, the distributor comprising:

a head;

an air nozzle and an output nozzle each molded of a single part of synthetic material and assembled in the head, an air circuit including at least, from upstream to downstream, an air inlet conduit at least partially formed in the air nozzle, a venturi at least partially formed in the air nozzle and an output conduit formed in the output nozzle, the venturi comprising a mixing chamber between the air nozzle and the output nozzle, a dip tube for channeling product to be sprayed extending according to a substantially vertical direction communicating with the mixing chamber which is immediately overhanging said dip tube, the head comprising an open well which opens vertically in the mixing chamber and wherein is nested said dip tube, said dip tube being free of any obstruction and freely communicating with the mixing chamber without any obstruction, and said air nozzle having a protruding portion which penetrates in the mixing chamber above the dip tube, said dip tube having an internal area having a first portion overhung by said protruding portion and a second portion not overhung by said protruding portion, a manual compressed-air generator communicating with the air inlet conduit, a reservoir adapted to contain product to be sprayed, communicating with the dip tube, wherein the venturi comprises a convergent section, and wherein the output conduit comprises a divergent section open towards atmosphere and a convergent section open towards the mixing chamber upstream of the divergent section.

2. The device according to claim 1, wherein the output conduit comprises an inlet cone open towards the mixing chamber, said inlet cone being arranged upstream of said convergent section and having an angle between 30 and 60 degrees and greater than an angle formed by the convergent section.

3. The device according to claim 1, wherein the air nozzle has an end in the form of a point forming said protruding portion.

4. The device according to claim 1, wherein the head comprises a nozzle housing extending horizontally and wherein the air nozzle and the output nozzle are nested.

5. The device according to claim 1, wherein the air nozzle and the output nozzle are nested in the head.

6. The device according to claim 1, wherein the head is molded of synthetic material.

7. The device according to claim 1, wherein the air inlet conduit has a first section and the venturi has a minimum section, said minimum section having an area between 1% and 6.5% of the area of said first section.

8. The device according to claim 1, wherein the air inlet conduit is formed at least partially in a tip fixed to the air nozzle by nesting and connected to said manual compressed-air generator.

9. The device according to claim 1, wherein the distributor comprises an inlet valve which is adapted to allow only the circulation of air towards the venturi and which is arranged on the air inlet conduit, said inlet valve comprising a valve member solicited by a spring towards a valve seat directed towards the venturi.

10. The device according to claim 1, wherein the output conduit has an output section area between 0.25 and 1.2 $mm^2$.

11. The device according to claim 1, wherein the dip tube has an internal diameter between 0.6 and 2 mm.

12. The device according to claim 1, wherein the head is covered by an added external envelope.

13. The device according to claim 1, wherein the manual compressed-air generator is a flexible bulb.

14. The device according to claim 1, wherein the manual compressed-air generator is a piston pump.

15. The use of a device according to claim 1, to spray a powdery product.

16. The use according to claim 15, wherein the powdery product is selected from among perfumery products and cosmetic products.

* * * * *

UNITED STATES PATENT AND TRADEMARK OFFICE

CERTIFICATE OF CORRECTION

PATENT NO. : 8,979,002 B2
APPLICATION NO. : 12/652848
DATED : March 17, 2015
INVENTOR(S) : Jaques Gerbron It is certified that error appears in the above-identified patent and that said Letters Patent is hereby corrected as shown below:

On the title page, please add:

Item --(22) PCT filed: July 3, 2008--
Item --(86) PCT No.: PCT/FR2008/057242--
Item --(87) PCT Publication No.: WO 2009/007657
PCT Publication Date: January 15, 2009--
Item --(30) Foreign Application Priority Date: July 6, 2007 FR 07 04898--

Signed and Sealed this
Twenty-first Day of June, 2016

Michelle K. Lee

Michelle K. Lee
*Director of the United States Patent and Trademark Office*